US010052546B2

(12) United States Patent
Kucera et al.

(10) Patent No.: US 10,052,546 B2
(45) Date of Patent: Aug. 21, 2018

(54) SYSTEMS AND METHODS ASSOCIATED WITH SHOULDER PROTECTION DEVICES

(71) Applicant: William A. Kucera, Thornton, CO (US)

(72) Inventors: William A. Kucera, Thornton, CO (US); J. C. Wingo, Austin, TX (US)

(73) Assignee: William A. Kucera, Thornton, CO (US)

( * ) Notice: Subject to any disclaimer, the term of this patent is extended or adjusted under 35 U.S.C. 154(b) by 320 days.

(21) Appl. No.: 15/158,666

(22) Filed: May 19, 2016

(65) Prior Publication Data

US 2016/0346663 A1 Dec. 1, 2016

Related U.S. Application Data

(60) Provisional application No. 62/166,083, filed on May 25, 2015.

(51) Int. Cl.
*A63B 71/12* (2006.01)

(52) U.S. Cl.
CPC ..... *A63B 71/12* (2013.01)

(58) Field of Classification Search
CPC ..... A63B 71/12
USPC ..... 2/459, 461, 45
See application file for complete search history.

(56) References Cited

U.S. PATENT DOCUMENTS

| | | | | |
|---|---|---|---|---|
| 4,679,253 | A * | 7/1987 | Mitchell | A63B 71/12 2/45 |
| 8,869,315 | B2 * | 10/2014 | Contant | A41D 13/0153 2/267 |
| 2004/0003448 | A1 * | 1/2004 | Morrow | A63B 71/12 2/92 |
| 2010/0192287 | A1 * | 8/2010 | Kraemer | A63B 71/12 2/459 |
| 2013/0145531 | A1 * | 6/2013 | Fratesi | A41D 13/0512 2/462 |
| 2016/0346663 | A1 * | 12/2016 | Kucera | A63B 71/12 |

* cited by examiner

*Primary Examiner* — Gloria Hale
(74) *Attorney, Agent, or Firm* — Pierson IP, PLLC

(57) ABSTRACT

Embodiments described herein relate to shoulder protection devices that are configured to reduce compression injuries to an athlete's shoulder. Embodiments are configured to limit the axis of rotation of a compression deflection lever coupled to an arch of a shoulder protection device.

20 Claims, 7 Drawing Sheets

SYSTEMS AND METHODS ASSOCIATED WITH SHOULDER PROTECTION DEVICES

CROSS-REFERENCE TO RELATED APPLICATIONS

This application claims a benefit of priority under 35 U.S.C. § 119 to Provisional Application No. 62/166,083 filed on May 25, 2015, which is fully incorporated herein by reference in its entirety.

TECHNICAL FIELD

Embodiments disclose systems and methods for shoulder joint protection. More specifically, embodiments disclose shoulder joint protection that is configured to restrict compressive forces applied to an athlete's shoulder.

BACKGROUND

Shoulder pads are pieces of protective equipment that are used in many contact sports, such as football, lacrosse, and hockey. Conventional shoulder pads consist of a shock absorbing foam material with a hard, rigid outer covering. Various styles of shoulder pads exist for different sports, and different positioned within sports.

Players are required to wear shoulder pads to reduce the occurrence of injury. The football shoulder pads are comprised of rigid arches that extend over the shoulders and include anterior and posterior portions. The anterior portions may be connected together on a vertical line over the athlete's sternum, and the posterior portions may be hinged along a vertical axis over the athletes back or spine.

Conventional shoulder pads also include a side pad assembly, which comprises an epaulet and a shoulder cup. The side pad assembly is configured to pad the athlete's shoulder. With conventional shoulder pad devices, the epaulet is pivotally connected to the arch member by a first strap and the shoulder cup is pivotally connected to the arch member by a second strap, wherein the epaulet overlies the shoulder cup.

However, in conventional shoulder pads, the downward range of motion of the epaulet and shoulder cup is not restricted. Therefore, if downward or lateral force is applied to the epaulet or cup, the force may compress the epaulet or cup against the athlete's shoulder, causing injuries. i.e.; ac-joint separation or clavicle fractures Accordingly, needs exist for a shoulder protective device that restricts the rotation of an epaulet or cup against the athlete, while allowing the epaulet and cup to be freely rotated upward.

SUMMARY

Embodiments described herein relate to shoulder protection devices that are configured to reduce compression injuries to an athlete's shoulder. Embodiments are configured to limit the axis of rotation of a compression deflection lever coupled to an arch of the shoulder protection device. The compression deflection lever may have freely rotate upward, but may have a limited range of rotation downward. Accordingly, if an athlete's shoulder receives an angular or lateral force from an impact, the shoulder protection device may limit the compressive forces applied to the athlete's shoulder.

In embodiments the shoulder protection device may include an arch, hinge compression deflection fulcrum arch, compression deflection lever, and a cup.

The arch may be configured to arch over a right or left shoulder of an athlete. The arch may be configured to interconnect a front portion and the back portion of the shoulder protection device. In embodiments, the arch may have an offset apex. The apex of the arch may be offset such that a length of a front portion of the arch in-front of the apex is longer than a length of a portion of the arch behind the apex of the arch.

The hinge may be a compression deflection lever fulcrum hinge or a top arch hinge that is configured to be coupled with the arch and the compression deflection lever. The hinge may be configured to limit the rotation of the compression deflection lever.

The compression deflection fulcrum arch may be an arch that is configured to be positioned over or under the arch. A first portion of the compression deflection fulcrum arch may be positioned behind a perimeter of the arch and a second portion of the compression deflection fulcrum arch may be positioned in front of the perimeter of the arch. The first portion of the compression deflection fulcrum arch may be configured to allow the compression deflection fulcrum arch to be coupled with the arch. The second portion of the compression deflection fulcrum arch may form a ledge, projection, bracket, etc. to limit the axis of rotation of the compression deflection lever.

The compression deflection lever may be configured to protect a shoulder of the athlete. In embodiments, a first end of the compression deflection lever may be configured to be coupled to the arch and/or compression deflection fulcrum arch, and a second end of the compression deflection lever may be configured to extend past a second end of the compression deflection fulcrum arch. The compression deflection lever may have a longer length than compression deflection fulcrum arch, wherein the first end of the compression deflection lever may be positioned behind the ledge, and the second end of the compression deflection lever may be positioned in front of the ledge. Thus, the first end of the compression deflection lever may overlap the arch and compression deflection fulcrum arch.

The cup may be configured to further protect the shoulder of the athlete. Similar to the compression deflection lever, the cup may be configured to be positioned over the shoulder of the athlete. In embodiments, the cup may be configured to be coupled to the compression deflection lever, wherein a portion of the cup may be positioned under the second end of compression deflection lever.

In embodiments, responsive to the athlete performing actions to raise their arms and shoulder above the compression deflection fulcrum arch, the compression deflection lever and/or cup may correspondingly move with the athlete's shoulders and arms. Responsive to the athlete performing actions to lower their arms and shoulder below the compression deflection fulcrum arch, the compression deflection lever and/or cup may remain in place in a plane defined by the compression deflection fulcrum arch.

More specifically, because the compression deflection fulcrum arch extends past the perimeter of the arch and a rotational point of the compression deflection lever is positioned behind the perimeter of the compression deflection fulcrum arch, the compression deflection fulcrum arch may form a platform, shelf, ledge, etc. that limits the downward rotation of the compression deflection lever and/or cup. Accordingly, responsive to the athlete receiving force to lower their arms and shoulder below the axis of the compression deflection fulcrum arch, the compression deflection lever and/or cup may remain in place in a fixed plane, which may limit, reduce, or restrict compressive force applied to the athlete's shoulder.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions, or rearrangements may be made within the scope of the invention. The invention includes all such substitutions, modifications, additions or rearrangements.

BRIEF DESCRIPTION OF THE DRAWINGS

Non-limiting and non-exhaustive embodiments of the present embodiments are described with reference to the following figures, wherein like reference numerals refer to like parts throughout the various views unless otherwise specified.

Figure 1:
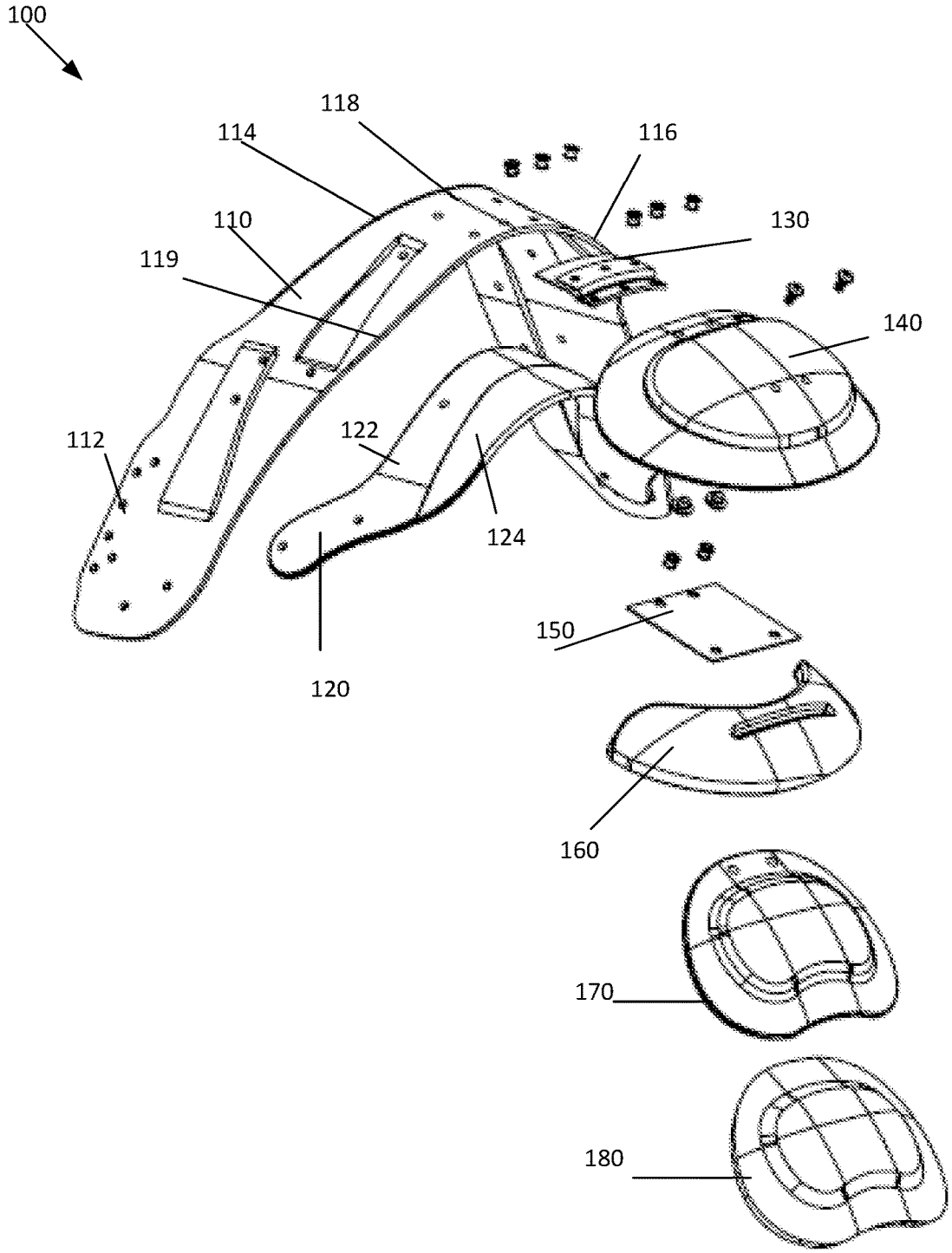
FIG. 1 depicts a portion of a shoulder protection device configured to limit compression to an athlete's shoulder, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Embodiments described herein relate to shoulder protection devices that are configured to reduce compression injuries to an athlete's shoulder. Embodiments are configured to limit the rotation of a compression deflection lever coupled to an arch of the shoulder protection device. The compression deflection lever may have a free range of motion above the arch, but may have a limited range of motion below the arch. Accordingly, if an athlete's shoulder receives force from an impact, the shoulder protection device may limit the compressive forces applied to the athlete's shoulder.

Turning now to FIG. 1, FIG. 1 depicts a portion of a shoulder protection device 100 configured to limit compression force to an athlete's shoulder, according to an embodiment. Shoulder protection device 100 may include an arch 110, compression deflection fulcrum arch 120, a hinge 130, compression deflection lever fulcrum 140, a compression deflection lever fulcrum 140, a under cup connection 150, compression deflector lever foam 160, a under cup 170, and under cup foam 180

Arch 110 may form a base structure of shoulder protection device 100, wherein arch 110 may be configured to arch over a right or left shoulder of an athlete. Arch 110 may include a front portion 112, a top portion 114, and a rear portion 116. Front portion 112 of arch 110 may be configured to be positioned in front of an athlete or wearer, top portion 114 of arch 110 may be configured to be positioned over the athlete's shoulder, and back portion 116 of arch 110 may be configured to be positioned behind the athlete. Apex 118 of arch 110 may be offset, wherein arch 110 does not form a bell curve. This may lead to front portion 112 and rear portion 116 of arch 110 not being symmetrical. Apex 118 of arch 110 may be offset such that a length of front portion 112 of arch 110 in-front of apex 118 is longer than a length of rear portion 116 of arch 110 behind apex 118 of arch 110. Thus, arch 110 may be a skewed arch, where arch 110 is negatively skewed. However, in other embodiments arch 110 be positively skewed or form a bell curve.

Compression deflection fulcrum arch 120 may be an arch that is configured to be positioned over or below arch 110. Compression deflection fulcrum arch 120 may include a first portion 122 and a second portion 124. First portion 122 of compression deflection fulcrum arch 120 may be positioned behind and below a perimeter 119 of arch 110. Accordingly, first portion 122 of compression deflection fulcrum arch 120 may have an overlapping surface with arch 110. First portion 122 of compression deflection fulcrum arch 120 may be configured couple compression deflection fulcrum arch 120 with arch 110. Utilizing fasteners, screws, bolts, pins, etc. that extend through arch 110 and compression deflection fulcrum arch 120, compression deflection fulcrum arch 120 and arch 110 may be coupled together, wherein compression deflection fulcrum arch 120 is fixed in place.

Second portion 124 of compression deflection fulcrum arch 120 may form a ledge, projection, bracket, etc. Second portion 124 of compression deflection fulcrum arch 120 may be positioned in front of perimeter 119 of arch 110, and extend in front of permitted 119 of arch 110. Accordingly, second portion 124 of compression deflection fulcrum arch 120 may not be overlapping with surface with arch 110.

Compression deflection lever fulcrum hinge 130 may be a coupling hinge configured to couple compression deflection lever fulcrum 140 with arch 110. Compression deflection lever fulcrum hinge 130 may have a coupling portion and a projection, wherein the projection is substantially shorter than the coupling portion. The coupling portion may be substantially a reverse "C" shape with a shorter overhang than a bottom lip. The bottom lip of compression deflection lever fulcrum hinge 130 may be configured to be inserted below arch 110 and above compression deflection fulcrum arch, wherein a front of arch 110 may be positioned within the reverse C. The projection may be configured to extend away from the reverse C, and be configured to be positioned underneath compression deflection lever fulcrum 140. In embodiments, due to the short length of the projection and the affixing the coupling portion to the arch, compression deflection lever fulcrum hinge 130 may be configured to limit or suppress the downward rotation of compression deflection lever fulcrum 140.

Compression deflection lever fulcrum 140 may be a device configured to protect a shoulder of the athlete or wearer. Compression deflection lever fulcrum 140 may be configured to be positioned over compression deflection fulcrum arch 120 and below arch 110. In embodiments, compression deflection lever fulcrum 140 may be configured to be inserted into a gap between arch 110 and compression deflection fulcrum arch 120. Compression deflection lever fulcrum 140 may be coupled with arch 110 and compression deflection fulcrum arch 120 at a position between arch 110 and first portion 122, wherein the rotational axis of compression deflection lever fulcrum 140 may positioned at the projection of compression deflection lever fulcrum hinge 130. Due to the positioning of the rotational axis and the ledge formed by compression deflection fulcrum arch 120, the compression deflection lever fulcrum 140 will not be able to rotate below a plane defined by the upper surface of compression deflection fulcrum arch 120. Yet, the compression deflection lever fulcrum 140 may freely rotate above the plane defined by the upper surface of compression deflection fulcrum arch 120.

Under cup connection 150 may be a device that is configured to couple compression deflection lever fulcrum 140, compression deflector lever foam 160, and under cup 170. Under cup connection 150 may be a substantially planar surface. In embodiments, the substantially planar surface may be malleable, bendable, etc., wherein the planar surface may be folded over itself based on desired force dissipation characteristics. For example, in one embodiment, the planar surface may be curved in multiple directions to be a substantially "z" or "s" shaped, and may have an upper surface that is longer than a lower surface. The curvature of cup connector 150 may allow cup connection 150 to compress and extend to suppress force applied to compression deflection lever fulcrum 140 and/or cup 170. The upper surface may be configured to be coupled with compression deflector lever fulcrum 140 and compression deflector lever foam 160. The lower surface may be configured to be coupled with cup 170 and cup foam 180.

Compression deflector lever fulcrum foam 160 may be foam or padding that is configured to suppress or limit the forces applied to compression deflection lever fulcrum 140 and/or under cup 170. Compression deflector lever fulcrum foam 160 may have a slot, wherein coupling mechanisms may be inserted through to couple under cup connection 150, compression deflector lever 140, and compression deflector lever foam 160. Compression deflector lever fulcrum foam 160 may be configured to be positioned underneath compression deflector lever 140, and above under cup 170, compression deflector lever fulcrum foam 160 under cup connection 150 under cup connection 150

Under cup 170 may be a device configured to further protect the shoulder of the athlete or wearer. Similar to compression deflection lever fulcrum 140, cup 130 may be configured to be positioned over the shoulder, as well as the arm, of the athlete or wearer. Under cup 170 may be configured to be coupled under cup connection 150 under cup connection 150 and under cup foam 180.

Under cup foam 180 may be foam or padding that is configured to suppress or limit the forces applied to under cup 170. In embodiments, under cup foam 180 may be comprised as the same material as compression deflector lever foam 160. Based on the positioning of compression deflection lever fulcrum 140 and under cup 170, the upward movement of under cup 170 may be dependent on the movement of compression deflection lever fulcrum 140. Whereas, the downward movement of under cup 170 may be independent of the movement of compression deflection lever fulcrum 140. Accordingly, while the downward movement of compression deflection lever fulcrum 140 may be restricted due the compression deflection fulcrum arch 120 being positioned in front of the axis of rotation of compression deflection lever fulcrum 140, the compression deflection fulcrum arch 120 may not constrain the movement of under cup 170. However, in a similar manner to the compression deflection fulcrum arch 120 coupled to the arch 110 and compression deflection lever fulcrum 140, a second compression deflection fulcrum arch may be coupled to the compression deflection lever fulcrum 140 and under cup 170 to restrict the downward movement of the under cup 170.

Figure 2:
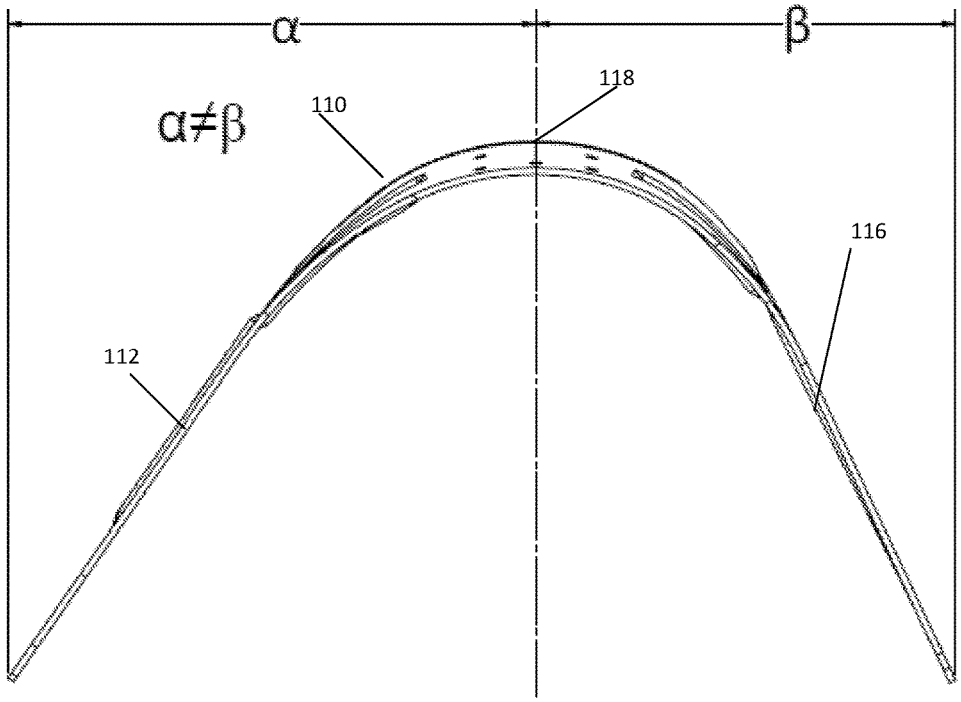
FIG. 2 depicts a side view of a portion of a shoulder protection device configured to limit compression to an athlete's shoulder, according to an embodiment.

FIG. 2 depicts a side view of a portion of a shoulder protection device 100 configured to limit compression to an athlete's shoulder, according to an embodiment. Elements depicted in FIG. 2 are described elsewhere in this document. For the sake of brevity, another description of these elements is omitted.

As depicted in FIG. 2, the apex 118 of arch 110 may be offset to have a negative or left skew. Therefore, front portion 112 of arch 110 may be longer than back portion 116. Furthermore, back portion 116 of arch 110 may be inclined at a sharper angle than front portion 112. The angle of back portion 116 may be sharper than angle of front portion 112, because back 116 is configured to extend in a direction that is substantially similar to a shape of an athlete's back, which may be perpendicular to a ground surface. Whereas, the angle of front portion 112 may be more linear and curve slightly outward in a direction that is substantially similar to the shape of an athlete's chest. Based on the geometry of arch 110, arch 110 may create a form fitting shoulder protection device 100 that reduces the movement of arch shoulder protection device 100 when being worn.

Figure 3:
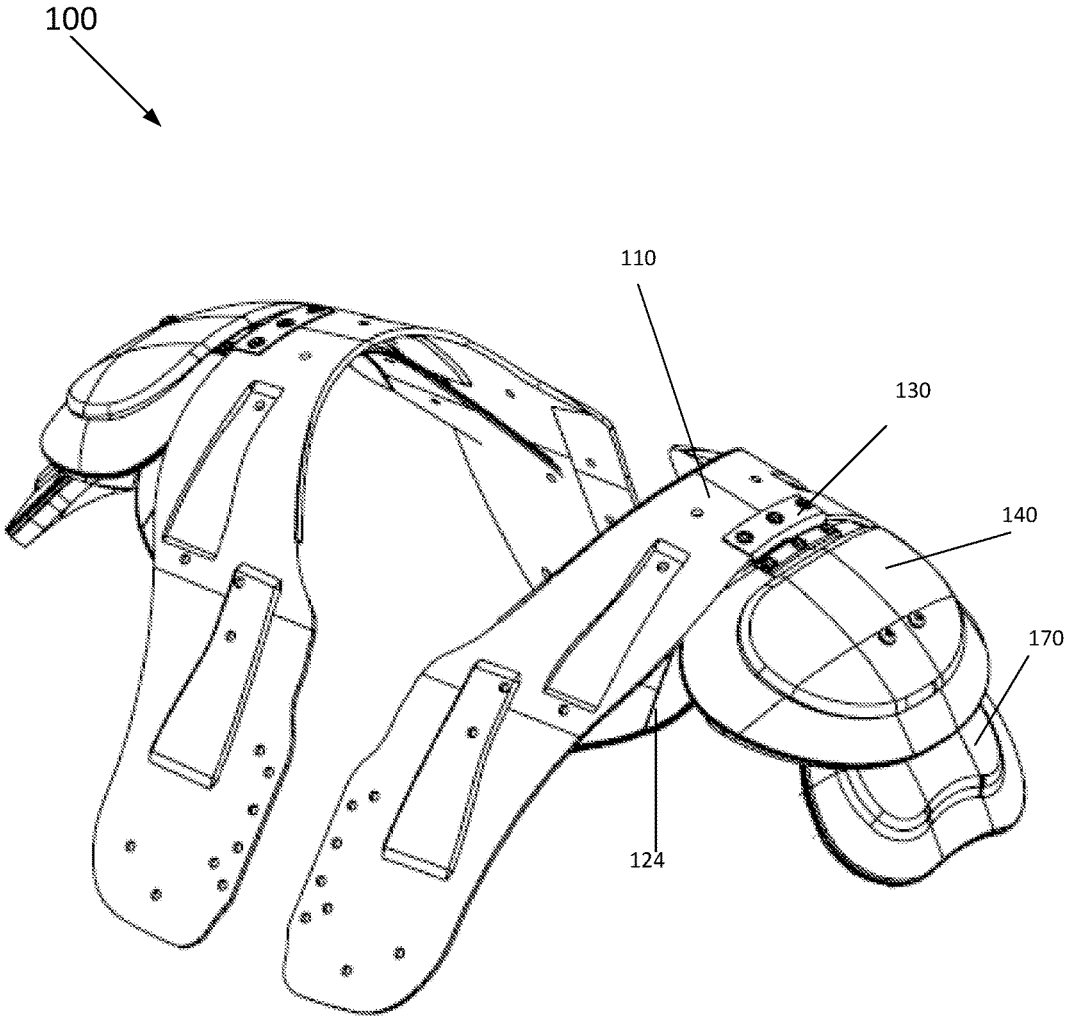
FIG. 3 depicts a top view of a portion of an assembled shoulder protection device configured to limit compression to an athlete's shoulder, according to an embodiment.
Figure 4:
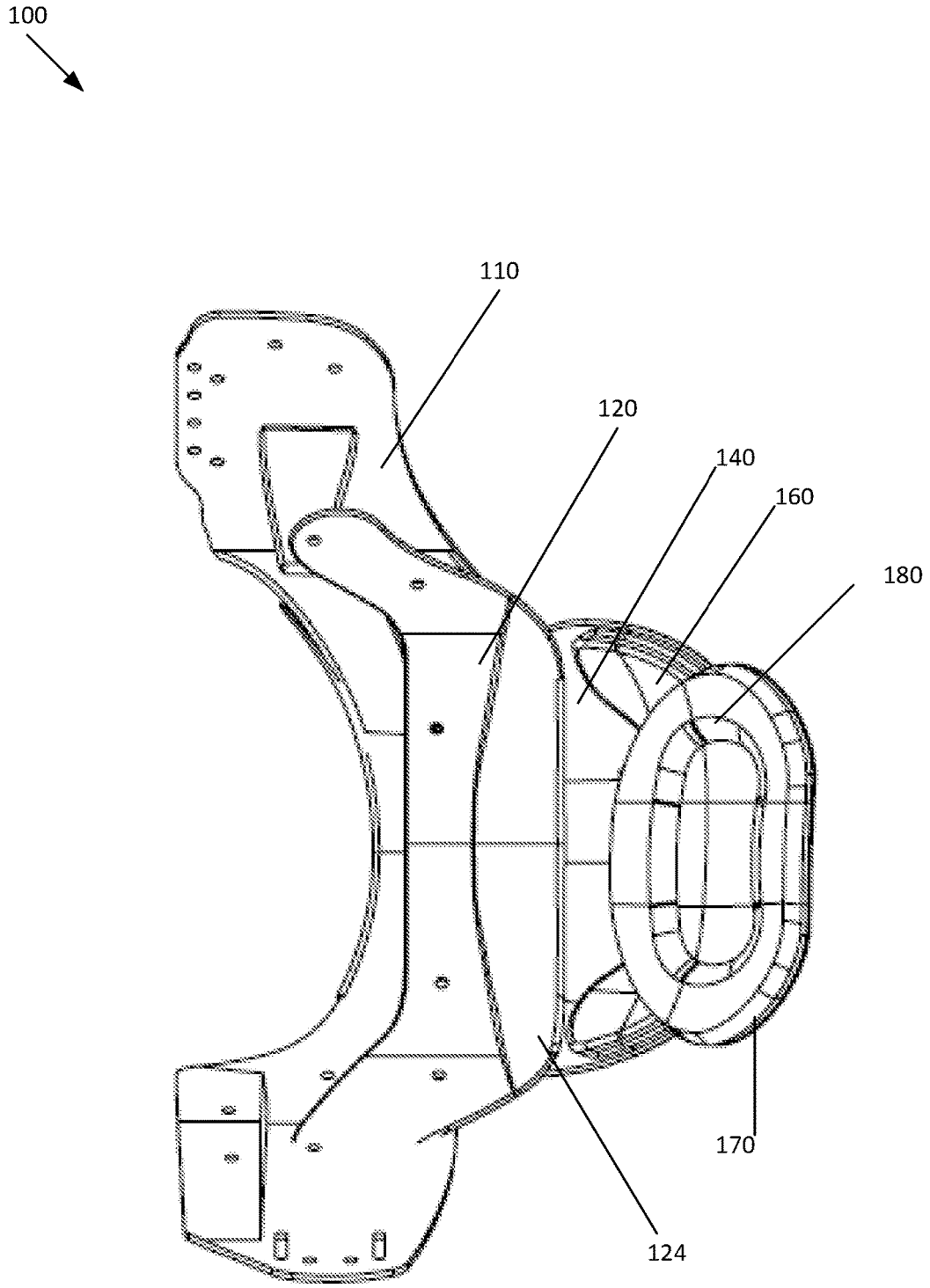
FIG. 4 depicts a bottom view of a portion of an assembled shoulder protection device configured to limit compression to an athlete's shoulder, according to an embodiment.

FIG. 3 depicts a top view of a portion of an assembled shoulder protection device 100 configured to limit compression to an athlete's shoulder, according to an embodiment. FIG. 4 depicts a bottom view of a portion of an assembled shoulder protection device 100 configured to limit compression to an athlete's shoulder, according to an embodiment. Elements depicted in FIGS. 3 and 4 are described elsewhere in this document. For the sake of brevity, another description of these elements is omitted.

As depicted in FIG. 3 and, second portion 124 of compression deflection fulcrum arch 120 may extend past the perimeter 119 of arch 110. This may allow compression deflection fulcrum arch to limit the downward rotation of compression deflection lever fulcrum 140. Furthermore, hinge 130 may have a planar sidewall that is configured to shift the rotational position and vertical offset of an upper surface of compression deflection fulcrum arch 120 and compression deflection lever fulcrum 140. This may further limit the downward rotation of compression deflection lever fulcrum 140.

Figure 5:
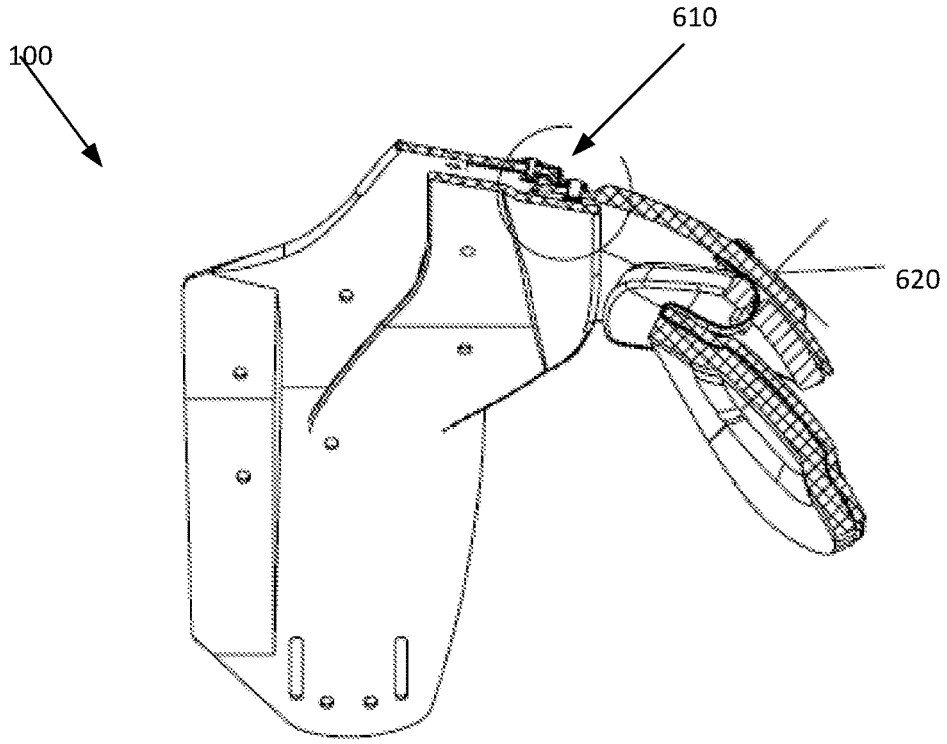
FIG. 5 depicts a front view of a portion of an assembled shoulder protection device configured to limit compression to an athlete's shoulder, according to an embodiment.
Figure 6:
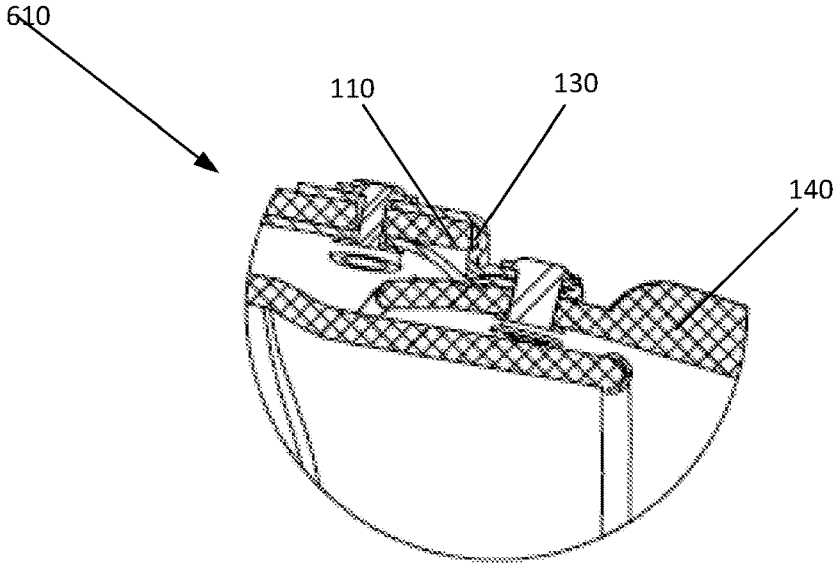
FIG. 6 depicts a zoomed view of a compression deflection hinge, according to an embodiment.
Figure 7:
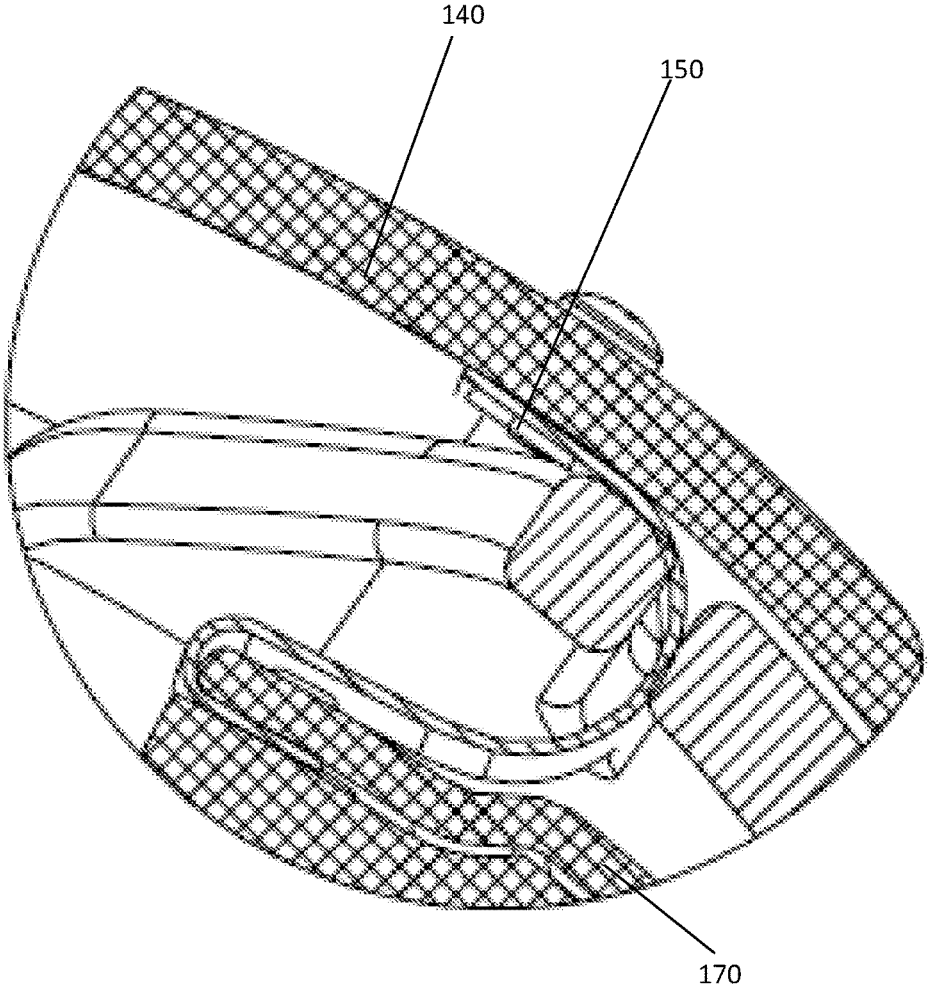
FIG. 7 depicts a zoomed view of a cup connector, according to an embodiment.

FIG. 5 depicts a front view of a portion of an assembled shoulder protection device 100 configured to limit compression to an athlete's shoulder, according to an embodiment. FIG. 6 depicts a zoomed view of a compression deflection lever fulcrum hinge 130, and FIG. 7 depicts a zoomed view of under cup connection 150, according to embodiments. Elements depicted in FIG. 5-7 are described elsewhere in this document. For the sake of brevity, another description of these elements is omitted.

As shown in FIG. 6 compression deflection lever fulcrum hinge 130 may be a coupling hinge configured to couple compression deflection lever fulcrum 140 with arch 110. Compression deflection lever fulcrum hinge 130 may have a coupling portion and a projection, wherein the projection is substantially shorter than the coupling portion. The coupling portion may be substantially a reverse "C" shape with a shorter overhang than a bottom lip. The bottom lip of compression deflection lever fulcrum hinge 130 may be configured to be inserted below arch 110 and above compression deflection fulcrum arch, wherein a front of arch 110 may be positioned within the reverse C. The projection may be configured to extend away from the reverse C, and be configured to be positioned underneath compression deflection lever fulcrum 140. In embodiments, due to the short length of the projection and the affixing the coupling portion to the arch, compression deflection lever fulcrum hinge 130 may be configured to limit or suppress the downward rotation of compression deflection lever fulcrum 140.

As shown in FIG. 7, under cup connection 150 under cup connection 150 may be a device that is configured to couple compression deflection lever fulcrum 140, compression deflector lever foam 160, and under cup 170. Cup connector 150 may be substantially "z" or "s" shaped, and may have an upper surface that is longer than a lower surface. The curvature of cup connector 150 may allow cup connector 150 to compress and extend to suppress force applied to compression deflection lever 140 and/or cup 170. The upper surface may be configured to be coupled with compression deflector lever 140 and compression deflector lever foam 160. The lower surface may be configured to be coupled with cup 170 and cup foam 180.

Figure 8:
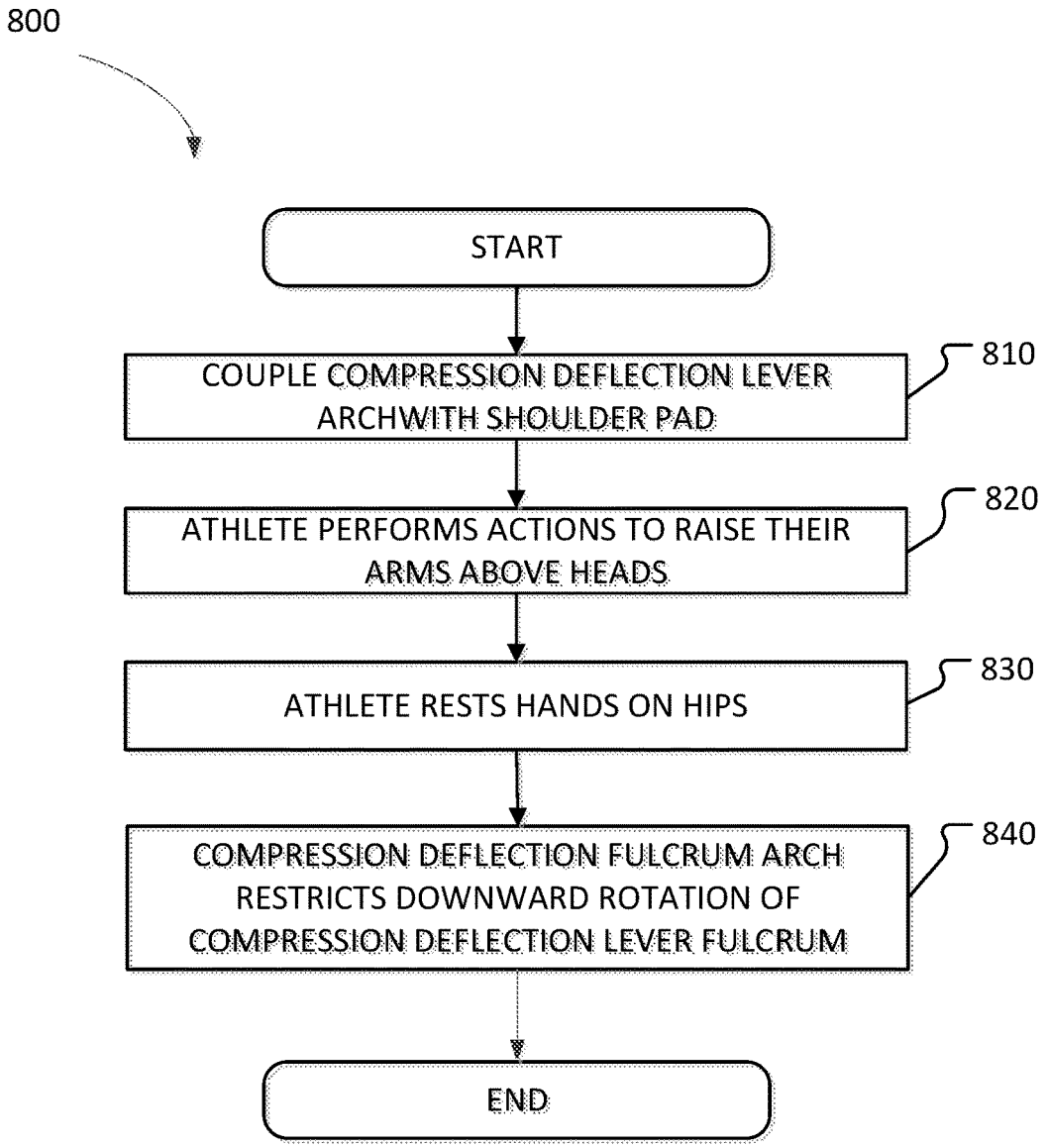
FIG. 8 illustrates a method for utilizing shoulder protection devices to reduce compression injuries, according to an embodiment.

FIG. 8 illustrates a method 800 for utilizing shoulder protection devices to reduce compression injuries. The operations of method 800 presented below are intended to be illustrative. In some embodiments, method 800 may be accomplished with one or more additional operations not described, and/or without one or more of the operations discussed. Additionally, the order in which the operations of method 800 are illustrated in FIG. 8 and described below is not intended to be limiting.

At operation 810, a compression deflection lever may be coupled to a shoulder protection device. The compression deflection lever may be coupled to the shoulder protection device at a position that is behind the perimeter of an arch and compression deflection fulcrum arch, wherein a front of the compression deflection lever extends past the perimeter of the compression deflection lever.

At operation 820, an athlete may perform actions to raise their arm above their heads. The compression deflection lever may freely rotate in an upward position, which may correspond to the athlete's arm movements.

At operation 830, the athlete may rest their hands on their hips. Responsive to the athlete resting their hands, the compression deflection lever may not rotate downward past a plane defined by the compression deflection fulcrum arch.

At operation 840, the shoulder of the athlete may receive a downward force. Responsive to receiving the downward force, the compression deflection fulcrum arch may restrict the downward rotation of the compression deflection lever to the plane defined by the compression deflection fulcrum arch.

In the foregoing specification, embodiments have been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of the invention.

Although the invention has been described with respect to specific embodiments thereof, these embodiments are merely illustrative, and are thus not restrictive of the invention. The description herein of illustrated embodiments of the invention is not intended to be exhaustive or to limit the invention to the precise forms disclosed herein (in particular, the inclusion of any particular embodiment, feature, or function is not intended to limit the scope of the invention to such embodiment, feature, or function).

Rather, the description is intended to describe illustrative embodiments, features and functions in order to provide a person of ordinary skill in the art context to understand the invention without limiting the invention to any particularly described embodiment, feature, or function. While specific embodiments of, and examples for, the invention are described herein for illustrative purposes only, various equivalent modifications are possible within the spirit and scope of the invention, as those skilled in the relevant art will recognize and appreciate.

As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes, and substitutions are intended in the foregoing disclosures. It will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Reference throughout this specification to "one embodiment," "an embodiment," "a specific embodiment" or similar terminology means that a particular feature, structure, or characteristic described in connection with the embodiment is included in at least one embodiment and may not necessarily be present in all embodiments. Thus, respective appearances of the phrases "in one embodiment," "in an embodiment," or "in a specific embodiment" or similar terminology in various places throughout this specification are not necessarily referring to the same embodiment.

Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/figures should be considered only as exemplary, and not limiting, unless otherwise specifically noted.

Furthermore, the term or as used herein is generally intended to mean "and/or" unless otherwise indicated. As used herein, a term preceded by "a" or an (and the when antecedent basis is "a" or "an") includes both singular and plural of such term (i.e., that the reference "a" or an clearly indicates only the singular or only the plural). Also, as used in the description herein, the meaning of in includes in and on unless the context clearly dictates otherwise.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A shoulder protection device, comprising:

an arch configured to be a base structure of the shoulder protection device, an apex of the arch including a negative skew such that the arch is asymmetrical;

a compression deflection fulcrum arch being coupled to the arch and being positioned below the arch, the compression deflection fulcrum arch including a first portion positioned rearward of a perimeter of the arch and a second portion positioned in front of the perimeter of the arch;

a compression deflection lever having a first end positioned between the arch and the compression deflection fulcrum arch, wherein the compression deflection fulcrum arch limits a downward rotation of the compression deflection lever, the compression deflection lever being coupled with the arch and the compression deflection fulcrum arch; and a compression deflection lever fulcrum hinge coupled with the compression deflection lever and the arch, the compression deflection lever fulcrum hinge including a coupling portion and a projection, the arch being configured to be inserted into the coupling portion and the projection being configured to be positioned over the compression deflection lever.

2. The shoulder protection device of claim 1, further comprising:

a cup connector configured to couple the compression deflection lever with a cup, the cup connector including two opposite facing curves.

3. The shoulder protection device of claim 2, wherein a bottom surface of the cup connector is shorter than a top surface of the cup connector.

4. The shoulder protection device of claim 2, wherein the cup connector is configured to compress responsive to receiving force.

5. The shoulder protection device of claim 2, wherein the cup is configured to be inserted into a lower facing curve of the cup connector.

6. The shoulder protection device of claim 5, wherein cup padding is configured to be positioned below the lower facing curve of the cup connector and the cup.

7. The shoulder protection device of claim 2, further comprising:

compression deflector lever foam configured to be positioned adjacent to the compression deflector lever, the compression deflector lever foam configured to receive an upper facing curve of the cup connector, the compression deflector lever foam including a slot across a top surface of the compression deflector lever foam, wherein coupling mechanisms are configured to be inserted through the compression deflector lever, the slot and the upper facing curve of the cup connector.

8. The shoulder protection device of claim 1, wherein a front portion of the arch positioned in front of the apex is longer than a rear portion of the arch positioned behind the apex.

9. The shoulder protection device of claim 1, wherein an upper surface of the coupling portion of the compression deflection fulcrum lever hinge is shorter than a lower surface of the coupling portion of the compression deflection hinge.

10. The shoulder protection device of claim 9, wherein the projection is positioned below the lower surface of the coupling portion of the compression deflection hinge.

11. A method of creating a shoulder protection device, the method comprising:

coupling a compression deflection fulcrum arch at a location below an arch, an apex of the arch including a negative skew such that the arch is asymmetrical, the compression deflection fulcrum arch including a first portion positioned rearward of a perimeter of the arch and a second portion positioned in front of the perimeter of the arch;

coupling a first end of a compression deflection lever between the arch and the compression deflection fulcrum arch, limiting a downward rotation of the compression deflection lever via the compression deflection fulcrum arch; and coupling the compression deflection lever and the arch via a compression deflection hinge, inserting the arch into a coupling portion of the compression deflection hinge;

coupling a projection of the compression deflection lever fulcrum hinge the arch over the compression deflection lever.

12. The method of claim 11, further comprising:

coupling the compression deflection lever with a cup via a cup connector, the cup connector including two opposite facing curves.

13. The method of claim 12, wherein a bottom surface of the cup connector is shorter than a top surface of the cup connector.

14. The method of claim 12, further comprising:

compressing the cup connector responsive to the cup connector receiving a force.

15. The method of claim 12, further comprising:

coupling the cup with the cup connector by inserting the cup into a lower facing curve of the cup connector.

16. The method of claim 15, further comprising:

coupling cup padding to the cup connector and the cup below the lower facing curve of the cup connector and the cup.

17. The method of claim 12, further comprising:

coupling compression deflector lever foam to the compression deflection lever at a location adjacent to the compression deflector lever, coupling an upper facing curve of the cup connector with the compression deflector lever foad, the compression deflector lever foam including a slot across a top surface of the compression deflector lever foam, inserting coupling mechanisms through the compression deflector lever, the slot, and the upper facing curve of the cup connector.

18. The method of claim 11, wherein a front portion of the arch positioned in front of the apex is longer than a rear portion of the arch positioned behind the apex.

19. The method of claim 11, wherein an upper surface of the coupling portion of the compression deflection fulcrum lever hinge is shorter than a lower surface of the coupling portion of the compression deflection hinge.

20. The method of claim 19, wherein the projection is positioned below the lower surface of the coupling portion of the compression deflection hinge.

* * * * *